US006520612B1

(12) United States Patent
Merz et al.

(10) Patent No.: US 6,520,612 B1
(45) Date of Patent: Feb. 18, 2003

(54) SENSING SYSTEM FOR DETECTING PRESENCE OF AN INK CONTAINER

(75) Inventors: Eric A. Merz, Palmyra, NY (US); Richard E. Butts, Rochester, NY (US); Dennis M. Lengyel, Hemlock, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/817,492

(22) Filed: Mar. 26, 2001

(51) Int. Cl.[7] ..... B41J 2/175

(52) U.S. Cl. ..... 347/7; 347/86

(58) Field of Search ..... 347/7, 19, 86, 347/87; 73/293, 323, 327; 250/577, 573, 574; 359/529, 53; 385/36

(56) References Cited

U.S. PATENT DOCUMENTS

| | | | | |
|---|---|---|---|---|
| 4,422,714 A | * 12/1983 | Benoit et al. | 385/39 |
| 4,571,599 A | 2/1986 | Rezanka | 346/140 R |
| RE32,572 E | 1/1988 | Hawkins et al. | 156/626 |
| 4,833,491 A | 5/1989 | Rezanka | 346/140 R |
| 5,138,332 A | 8/1992 | Carlotta | 346/1.1 |
| 5,221,397 A | 6/1993 | Nystrom | 156/273.5 |
| 5,742,312 A | 4/1998 | Carlotta | 347/87 |
| 5,997,121 A | 12/1999 | Altfather et al. | 347/7 |

FOREIGN PATENT DOCUMENTS

| | | | |
|---|---|---|---|
| EP | 860284 A2 * | 8/1998 | 347/7 |

* cited by examiner

*Primary Examiner*—Craig Hallacher
(74) *Attorney, Agent, or Firm*—Christopher D. Wait

(57) ABSTRACT

A low ink sensing system is combined with an ink cartridge detection system to enable a more efficient ink jet printer. An ink container which supplies ink to an associated printhead is modified by the incorporation of two light directing elements, in the preferred embodiment, a curvilinear prism-like structure and a curvilinear roof mirror, into a transparent wall of the container housing. The cartridge, comprising the ink container and associated printhead, is mounted on a scan carriage. Periodically, the carriage is conveyed to a sensing station comprising a pair of light sources and a commonly used photosensor. A first light source is energized and a beam of light is directed to a location where the curvilinear roof mirror would be positioned if the cartridge is present. If the cartridge is absent, lack of a reflected return signal is sensed, indicating a cartridge has not been inserted. Print operation is halted until a cartridge is inserted. If a cartridge is properly inserted, the curvilinear roof mirror returns most of the incident light to the photosensor which generates a signal indicating the presence of the cartridge. A second light source is then energized and directed towards the curvilinear prism-like structure, which is either immersed in ink or exposed to air within the interior of the container. If the latter, light is internally reflected by the curved surfaces back to the photosensor. If a print operation has been in progress, and the ink level has fallen, the common photosensor detects either a strong or weak redirected light component and initiates a status check and generates appropriate displays of low ink level or out of ink warnings.

11 Claims, 11 Drawing Sheets

SENSING SYSTEM FOR DETECTING PRESENCE OF AN INK CONTAINER

BACKGROUND AND MATERIAL DISCLOSURE STATEMENT

Cross reference is made to allowed patent application Ser. No. 09/305,990 to Altfather et al. (hereinafter "Altfather"), which is herein incorporated in its entirety for its teachings, and for which there is common assignment with the present application to the Xerox Corporation.

The present invention relates to ink jet recording devices and, more particularly, to a system for detecting the presence of an ink supply container and also for detecting when the level of ink in the container is at or below a predetermined level.

Ink jet recording devices eject ink onto a print medium such as paper in controlled patterns of closely spaced dots. To form color images, multiple groupings of ink jets are used, with each group being supplied with ink of a different color from an associated ink container.

Thermal ink jet printing systems use thermal energy selectively produced by resistors located in capillary filled ink channels near channel terminating nozzles or orifices to vaporize momentarily the ink and form bubbles on demand. Each temporary bubble expels an ink droplet and propels it toward a recording medium. The printing system may be incorporated in either a carriage type printer or a page-width type printer. A carriage type printer generally has a relatively small printhead containing the ink channels and nozzles. The printhead is usually sealingly attached to an ink supply container and the combined printhead and container form a cartridge assembly which is reciprocated to print one swath of information at a time on a stationarily held recording medium, such as paper. After the swath is printed, the paper is stepped a distance equal to the height of the printed swath, so that the next printed swath will be contiguous therewith. The procedure is repeated until the entire page is printed. In contrast, the page-width printer has a stationary printhead having a length equal to or greater than the width of the paper. The paper is continually moved past the page-width printhead in a direction normal to the printhead length at a constant speed during the printing process. Moving carriage type ink jet printers must either carry the ink container along with the printhead or provide a flexible ink supply line between the moving printhead and a stationary ink container. Page-width printers have an ink supply container located outside the print zone and directly connected to the print-bar ink channels.

For either a partial width printhead on a moving carriage or for a page-width print-bar, it is desirable to have a low ink level warning to alert a user to replace or refill the ink container so that the ink does not run out during a print job. Presently, for some applications (such as plotting), some users choose to install new print containers prior to starting an extensive printing job because it is less costly to replace a questionable container rather than lose one or more colors in the output prints. It is also important to ensure that the ink supply container is in the proper location; e.g., fluidly connected to the associated printhead. In some instances, an out of ink container may be removed but a replacement container neglected to be inserted. Printer operation with the container removed could potentially damage the associated printhead.

Various prior art methods and devices are known. One that is of note here is U.S. Pat. No. 5,997,121 to Altfather et al., which discloses a low ink sensing system combined with an ink cartridge detection system to enable a more efficient ink jet printer. An ink container which supplies ink to an associated printhead is modified by the incorporation of two light directing elements, in the preferred embodiment, a faceted prism and a roof mirror, into a transparent wall of the container housing. The cartridge, comprising the ink container and associated printhead, is mounted on a scan carriage. Periodically, the carriage is conveyed to a sensing station comprising a pair of light sources and a commonly used photosensor. A first light source is energized and a beam of light is directed to a location where the roof mirror, would be positioned if the cartridge is present. If the cartridge is absent, lack of a reflected return signal is sensed, indicating a cartridge has not been inserted. Print operation is halted until a cartridge is inserted. If a cartridge is properly inserted, the roof mirror returns most of the incident light to the photosensor which generates a signal indicating the presence of the cartridge. A second light source is then energized and directed towards the faceted prism, which is either immersed in ink or exposed to air within the interior of the container. If the latter, light is internally reflected by the prism facets back to the photosensor. If a print operation has been in progress, and the ink level has fallen, the common photosensor detects either a strong or weak redirected light component and initiates a status check and generates appropriate displays of low ink level or out of ink warnings.

Also of note is U.S. Design Pat. No. 425,110 to Dietl et al. for an Ink Tank. Provided therein is the ornamental design for an ink tank, as shown and described.

Therefore, as discussed above there exists a need for a technique which will solve the problem of providing a printer which can sense it's ink cartridge and whether that cartridge has ink inside it. Thus, it would be desirable to solve this and other deficiencies and disadvantages with an improved apparatus.

SUMMARY OF THE INVENTION

The present invention relates to an ink container comprising a housing, and a curvilinear light directing element on a wall of that housing for directing light received there away from the wall of the housing.

More particularly, the present invention relates to an ink container for use in a liquid ink printer comprising a housing defining a chamber for storing a supply of liquid ink. The invention further comprises an arched roof mirror comprising a first and a second curvilinear reflector on the exterior of a wall of the housing. The first curvilinear reflector substantially completely reflects light received there toward the second curvilinear reflector. The second curvilinear reflector substantially completely reflects light received there away from the wall of the housing on a light path offset from and parallel to the light path of the light received at the first reflector.

Further, the invention relates to a sensing system for detecting a presence of an ink container and a level of ink therein comprising a first curvilinear light directing element forming part of the ink container and a light source having output beams directed toward the first curvilinear light directing element when in an ink container detect mode. The system further comprises a first photosensor for detecting a presence or absence of light directed from the first curvilinear light directing element and for generating an output signal indicative thereof and a second curvilinear light directing element forming part of the ink container, the light source having output beams directed toward the second curvilinear light directing element when in a low ink level detect mode. Finally, the system also comprises a second photosensor for detecting light directed from the second curvilinear light directing element, the level of detected light and, hence, the level of the photosensor output being representative of a presence or absence of the ink level adjacent the interior surface of the second curvilinear light directing element.

DESCRIPTION OF THE INVENTION

Figure 1:
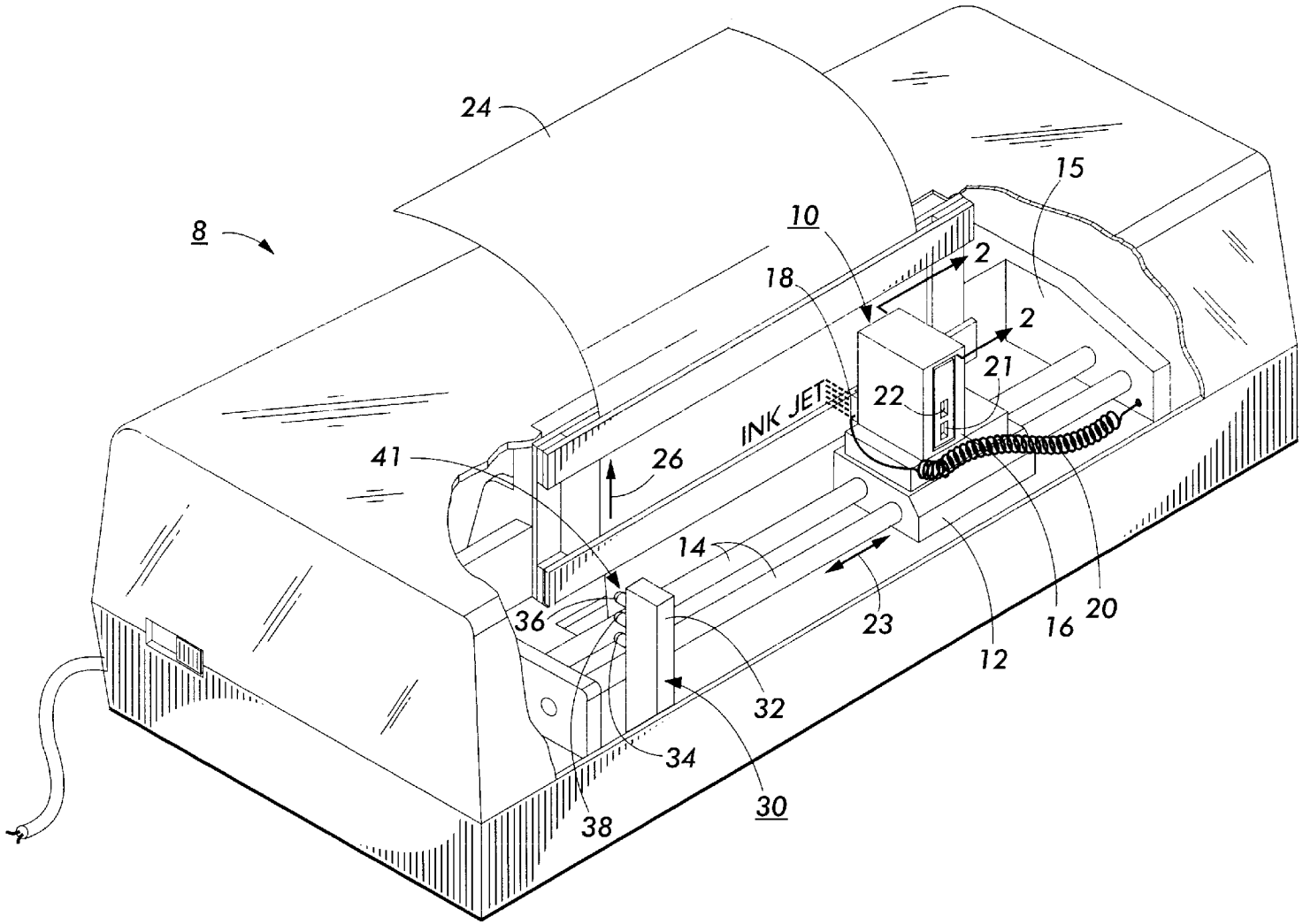
FIG. 1 illustrates a perspective view of an ink jet printer which incorporates the ink container and low ink level sensing system of the present invention.

FIG. 1 illustrates a perspective view of a thermal ink jet printer 8 which incorporates a preferred embodiment of the ink container and low ink detection system of the present invention. Printer 8 is exemplary only. The invention can be practiced in other types of thermal ink jet printers as well as other reproduction devices such as piezoelectric printers, dot matrix printers and ink jet printers driven by signals from a document Raster Input Scanner. Printer 8 includes an ink jet printhead cartridge 10 mounted on a carriage 12 supported by carriage rails 14. The carriage rails are supported by a frame 15 of the ink jet printer 8. The printhead cartridge 10 includes a container 16 shown in detail in FIG. 2, containing ink for supply to a thermal ink jet printhead 18 which selectively expels droplets of ink under control of electrical signals received from a controller 50 (FIG. 4) of the printer 8 through an electrical cable 20. Container 16 comprises a housing 17 having a wall 17A seating reflective elements 21 and 22, shown in further detail in FIG. 2. Container 16 is fluidly, but detachably connected, to printhead 18 and can be replaced when the ink is depleted therefrom. Alternatively, the entire cartridge can be replaced upon each depletion depending upon the particular system requirements. The printhead 18 contains a plurality of ink channels which carry ink from the container 16 to respective ink ejecting orifices or nozzles. When printing, the carriage 12 reciprocates back and forth along the carriage rails 14 in the direction of the arrow 23, the entire width traverse constitutes a scanning path. The actual printing zone is contained within the scanning path. As the printhead cartridge 10 reciprocates back and forth along a print path and past a recording medium 24, such as a sheet of paper or a transparency, droplets of ink are expelled from selected ones of the printhead nozzles towards the sheet of paper. Typically, during each pass of the carriage 12, the recording medium 24 is held stationary. At the end of each pass, the recording medium 24 is stepped in the direction of the arrow 26. For a more detailed explanation of the operation of printer 8, reference is hereby made to U.S. Pat. No. 4,571,599 and U.S. Pat. No. Reissue 32,572, which are incorporated herein by reference in their entirety for their teaching.

Figure 2:
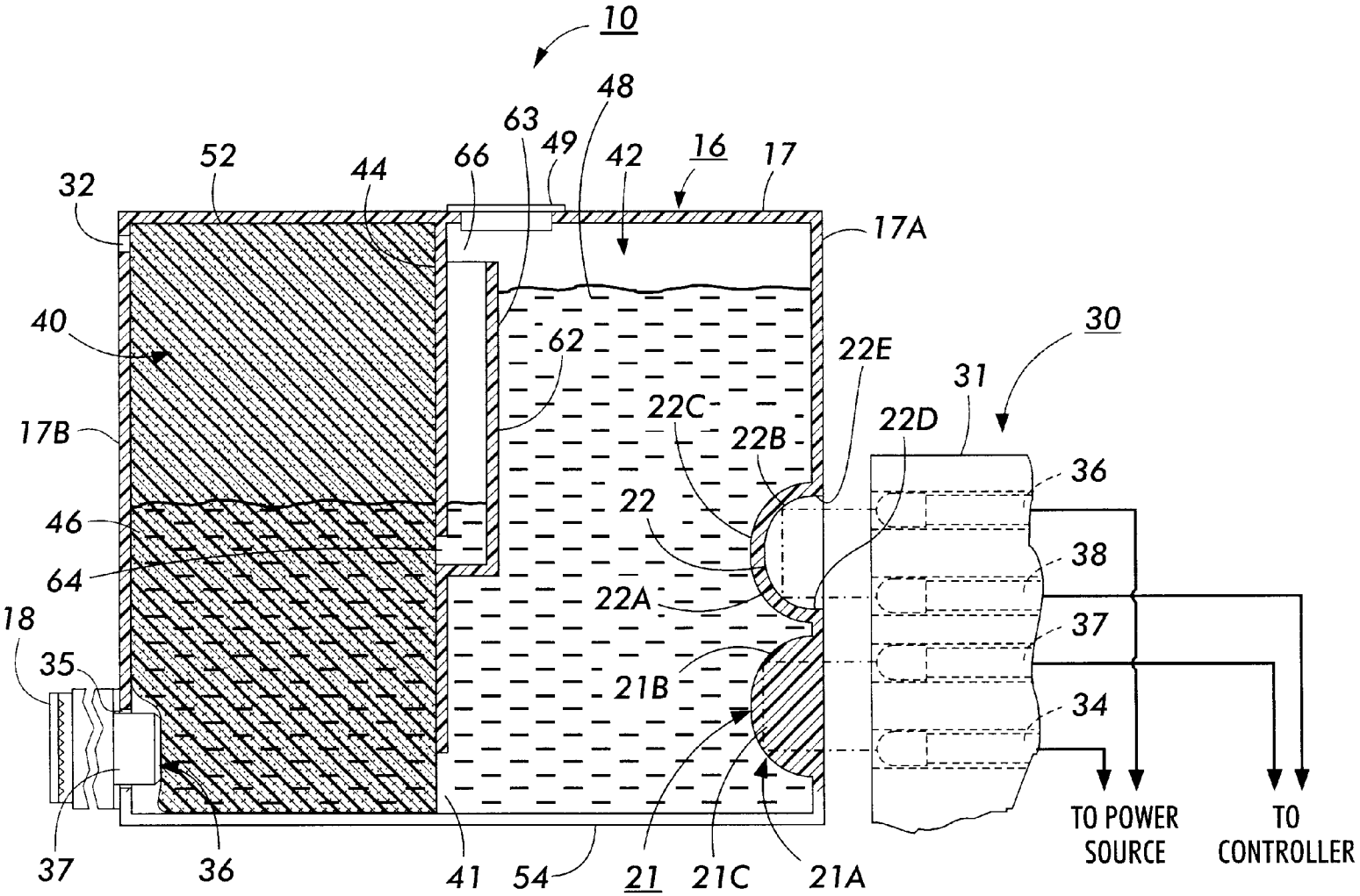
FIG. 2 is a cross-sectional view through the ink cartridge shown in FIG. 1.

Also shown in FIG. 1 is an optical sensing assembly 30. Referring to FIGS. 1 and 2, assembly 30 includes a housing 31 within which are mounted a first light source 34, a second light source 36, a first photosensor 37, and a second photosensor 38 located between the two light sources and commonly used therewith as will be seen. In an alternative preferred embodiment only one photosensor is used and it is shared between the two light sources. The light sources are electrically connected to a power source while the photosensor 37 and 38 output is electrically connected into the system controller circuits as will be seen. Container 16, in a preferred embodiment, is designed as a two compartment unit. Assembly 30 is mounted in the carriage path so that, as container housing wall 17A moves into a position opposite the assembly 30, the light from light source 34 is directed toward light directing element 21, and light from light source 36 is directed toward light directing element 22. Photosensor 37 is positioned to detect light directed from element 21 and photosensor 38 is positioned to detect light directed from element 22 in the manner described in further detail below.

FIG. 2 includes a cross-sectional view of the printhead cartridge 10 along the line 2—2 of FIG. 1 and shows the housing 17 and the printhead 18 attached to the container. The printhead 18 is fluidly but detachably connected to the container 16. The housing 17 is made of a lightweight but durable plastic, which in a preferred embodiment, is polypropylene. Housing 17 has an air inlet 32 and an ink outlet 35 formed within wall 17B. The air inlet 32 provides for the transfer of air between the interior of housing 17 and the ambient. Ink outlet 35 provides for fluid transfer of ink contained in the ink container 16 from the interior of the housing 17 to the ink jet printhead 18. Manifold 37 directs filtered ink from the ink outlet 35 into printhead 18 and to the ink ejecting orifices for ejecting ink onto the recording medium 24.

Housing 17 defines an interior space partitioned into a first chamber 40 and a second chamber 42 by a dividing member 44. The dividing member 44 extends from one side wall of the housing 17 to an opposite side wall of the housing and essentially divides the housing into the first chamber 40 and the second chamber 42 such that the second chamber 42 is larger than the first chamber 40.

The first chamber 40 contains an ink retaining member 46 typically made of a foam material to hold liquid ink. Liquid ink 48, stored in the second chamber 42, is transferred from the second chamber 42, which is substantially free of ink retaining material, to the ink retaining material 46 through an ink inlet 41 defined by the dividing member 44. A fill port 49 allows for filling the cartridge with ink.

The ink 48 passes into the ink retaining material 46 through the ink inlet 41 and ink is released through ink outlet 35 as necessary to supply the printhead 18 with ink for printing. To maintain a proper amount of ink in the ink retaining material 46 for supply to the printhead 18, the housing 17 includes a mechanism for transferring ink from the second chamber 42 to the first chamber 40 by maintaining a proper amount of air pressure above the liquid ink 48 for filling the material 46 with ink when necessary. This mechanism includes a directing member 63, which defines, with the dividing member 44, an air transfer passageway 62 having a vent inlet 64 coupled to a vent outlet 66 for pressurizing the second chamber 42 to a static (no flow) condition. The directing member 63 does not extend from one side-wall to an opposite side-wall as does the dividing member 44, but instead forms a vent tube.

The construction of the container 16 compartments as described to this point is exemplary. There are other known ways of constructing an ink supply container with dividing sections while maintaining an appropriate back pressure to the printhead nozzle. See, for example, the container described in U.S. Pat. No. 5,138,332 and in U.S. Pat. No. 5,742,312, both of which are incorporated by reference. For purposes of the present invention, it is understood that the container is constructed so that, during operation, ink moves from chamber 42 to chamber 40 through the passageway between the two compartments under pressure conditions established by techniques well known to those skilled in the art. Of interest to the present invention is the modification made to the ink container 16 by introducing the arch member 21 and arch roof mirror 22 to the wall 17A defining the rear of chamber 42.

Referring particularly to FIG. 2, in a preferred embodiment, light directing element 21 is a reflector integrally formed in the bottom half of wall 17A and made of the same light transmissive material as the wall; e.g., polypropylene. Polypropylene, or other hydrophilic materials are preferred. There are two shape type alternatives for a preferred embodiment: a curvilinear shape is constructed with just one curve 21; or in the alternative, a duo-curvilinear shape with two curves 21A, 21B. These may be thought of as curved facets or curvilinear reflective members. In either case, the shape extends into the interior of compartment 42. The curvilinear light directing element or member 21 may have an elliptical shape or even a semicircular so as to direct light from a light source 34 to a photoreceptor 37. The duo-curvilinear shape embodiment of light directing element 21 has curved surfaces 21A, 21B angled generally toward each other so as to direct and focus light from an emitter 34 to a receptor 37. Curved surface facets 21A, 21B may also be connected by facet surface 21C, which itself may be straight or curved, the exact shape being unimportant so long as there is no blockage of the light path.

Light directing element 22 is also formed as part of wall 17A. In a preferred embodiment, element 22 may be one of two shape types. It may have a curvilinear shape constructed of just one curve. In the alternative, it may be a duo-curvilinear shape with two curves 22A, 22B extending into the interior of compartment 42 and angled towards each other and connected by surface 22C. Either arrangement may be described as a curved facet or facets. Element 22 may be made more reflective by placing reflective films, foils or tapes 22D, 22E on surfaces 22A, 22B, respectively. However, in a preferred embodiment reflective films may no longer be needed because the light gathering action of the curvilinear surfaces renders such unnecessary. In this arrangement described above, light may be directed and focused from an emitter 36 to a receptor 38.

It will be appreciated from the above that only a portion of wall 17A need be transmissive; e.g., the portion accommodating reflective element 21. Further, while the preferred embodiment has the reflective elements constructed integrally with the housing wall, the elements could be separately positioned adjacent the interior surface of wall 17A.

OPERATION OF SENSING SYSTEM

Figure 3:
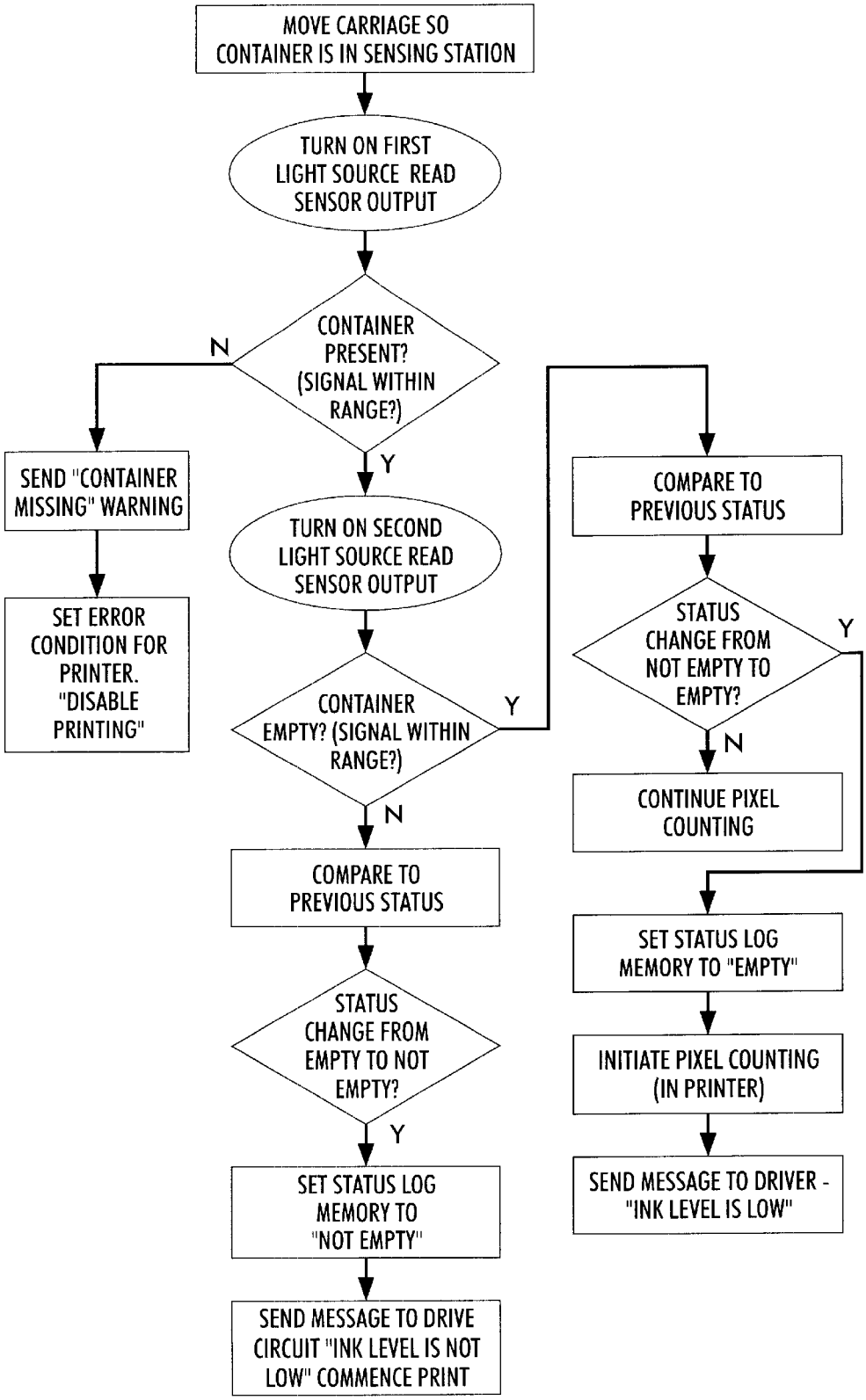
FIG. 3 is an algorithm which is used to sequence the checks to determine presence or absence of a container as well as level of ink within the container.
Figure 4:
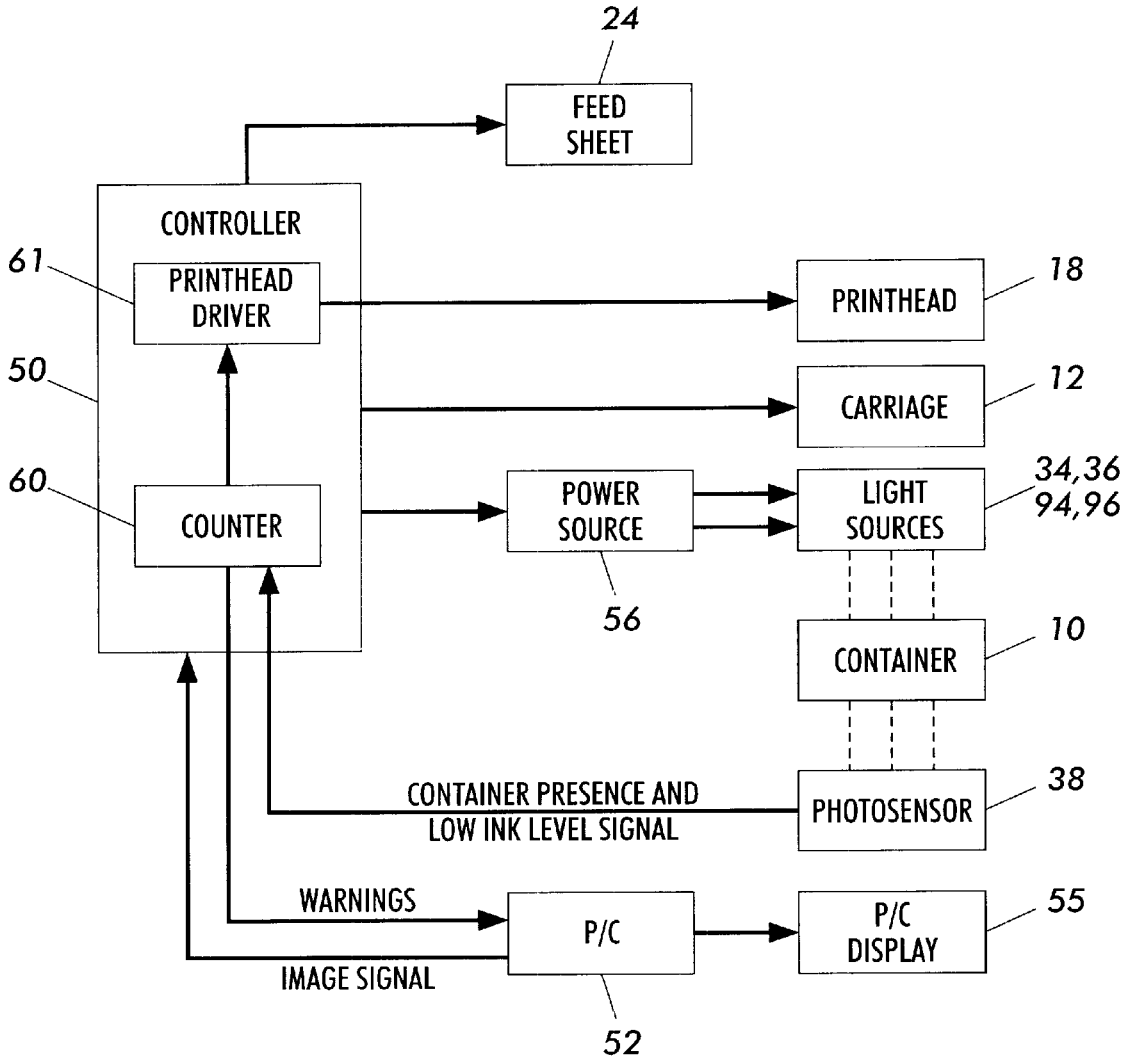
FIG. 4 is a block diagram of the control circuitry for controlling operation of the sensing system.

The sensing system of the present invention, which is considered to comprise the combination of reflective elements 21, 22 and the optical assembly 30, is designed to be enabled to perform an ink container presence and a low ink level check following a specific events such as the start of a print job or after the printing of a certain amount of prints. To perform the checks, the printer follows an algorithm that requires the ink container to be positioned adjacent assembly 30 and then sequenced through a series of detection steps. FIG. 3 is one embodiment of an algorithm that can be used. FIG. 4 shows control circuitry for implementing the ink container and ink level sensing system. A main controller 50 conventionally includes a CPU, a ROM for storing complete programs and a RAM. Controller 50 controls the movement of carriage 12 as well as other printer functions described below.

When a line recording operation is performed, each resistor associated with a jet in printhead 18 is driven selectively in accordance with image data from a personal computer P/C 52 or other data source sent into controller 50. Controller 50 sends drive signals to the printhead heater resistors causing ink droplets to be ejected from the jets associated with the heated resistor thus forming a line of recording on the surface of the recording medium 24. With continued operation of the printhead, ink contained in chamber 42 of container 16 gradually becomes depleted until a level is reached which has been predetermined to constitute a low ink level.

For purposes of description, the sensing system will be considered as being activated, first at the beginning of a print job, and at a later time following a preset period of printer operation.

OPERATION AT START OF PRINT JOB

Referring to FIGS. 1–4, image signals from the P/C 52 to controller 50 initiate a start print sequence. Carriage 12 is moved to sensing station 41 so as to position housing wall 17A of container 16 adjacent and facing the optical assembly 30. Under control of controller 50, a power source 56 first energizes light source 36. Source 36, in a preferred embodiment, is an LED with a peak wavelength in the range of 830 to 940 nm. A beam of light is directed towards housing wall 17A and, if a container is present, light is reflected from surfaces 22A, 22B of roof mirror 22 and redirected so as to impinge on photosensor 38. The two reflections allow the beam to be stepped vertically downward to avoid a higher than acceptable angle of incidence at the detector. The output signal from photosensor 38 is sent to logic circuitry within controller 50, which determines that the signal is within a preset range. The controller then sequences to power the second light source 34.

If a container 16 is not present, the light output of source 36 will not be reflected back to photosensor 38. The lack of output from the photosensor will be recognized in the computer as a "container missing" status. The printer will be disabled, and a warning display will be activated at P/C Display 55 informing the user that a) printing of the color associated with the missing tank will be prevented and b) the correct container should be installed to prevent potential damage to the printhead.

Figure 5A:
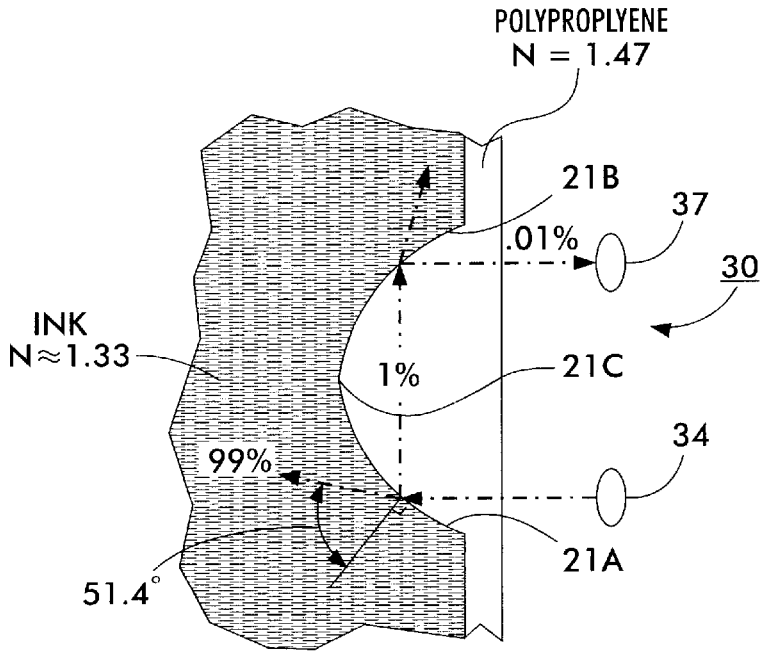
FIG. 5A is a cross-section of a curvilinear reflective element within the cartridge showing the prism container with a sufficient level of ink.

In a preferred embodiment, light source 34 is also an LED with characteristics similar to source 36. Source 34 emits a beam of light which is transmitted through wall 17A and is incident on curved surface area 21A of light directing element 21. FIG. 5A is a cross section of light directing element 21 and a schematic reproduction of the assembly 30 showing the path of the light beam when the light directing element, here a curvilinear prism like structure is still immersed in ink and, hence, the level of ink exceeds a preset low level.

The low ink detection is enabled by application of the principle of total internal reflection. Total internal reflection occurs when a ray, passing from a higher to a lower index of refraction (from N to N'), has an angle of incidence whose sine equals or exceeds N'/N. The critical angle $I_C$ is expressed by the equation:

$$I_C = \text{arc sin } N'/N \quad (1)$$

As shown in FIG. 5A, the output beam of LED 34 passes through wall 17A which, being polypropylene and with an index of refraction of approximately 1.492, is almost completely transparent to the light, allowing approximately 96% of the light incident thereon to pass through and be incident on curved surface area 21A at an angle of incidence of about 45° (at the center of the curve 21A). Since the back side of curved surface area 21A is immersed in ink with an index of refraction of about 1.33, and the critical angle is not reached, approximately 99% of the incident light will be transmitted into the ink and at an angle of refraction of about 51.4° and only approximately <1% will be reflected to curved surface area 21B. Since the interior facing side of curved surface area 21B is also immersed in ink, >99% of the 1% will also be transmitted into the ink. Only a very small amount (approximately 0.01%) of the original incident energy will be reflected towards the photosensor 37. The output signal from the photosensor at controller 50 will register a low light level falling outside a low ink level preset range set in controller memory. The controller will compare this signal to a previous status signal to determine whether a container, previously identified as being in a low ink situation, has been replaced or refilled. A status log is then set, or reset, to a "not empty" level, and the printhead drive circuit 61 in controller 50 is enabled to send drive signals to the printhead to initiate a print sequence. The low ink level threshold for this embodiment has been set at 20% of the container 16 fill level.

Figure 5B:
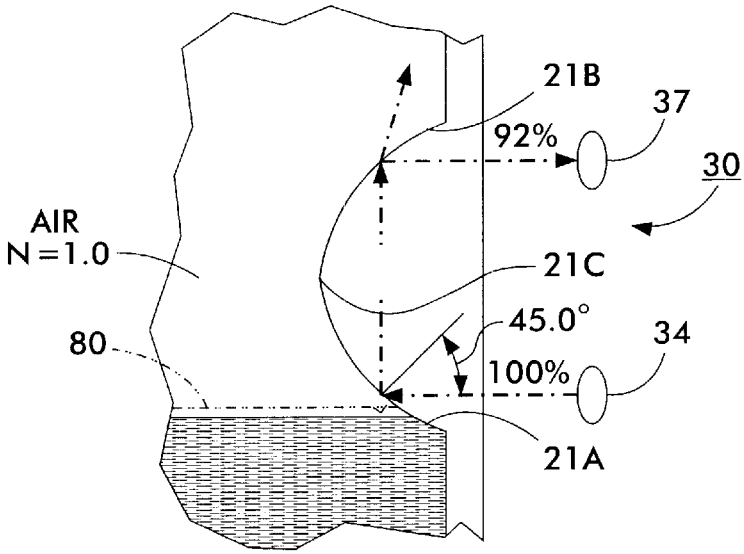
FIG. 5B is a cross-section of the curvilinear reflective element of FIG. 5A showing the reflection path in a low ink environment.
Figure 5C:
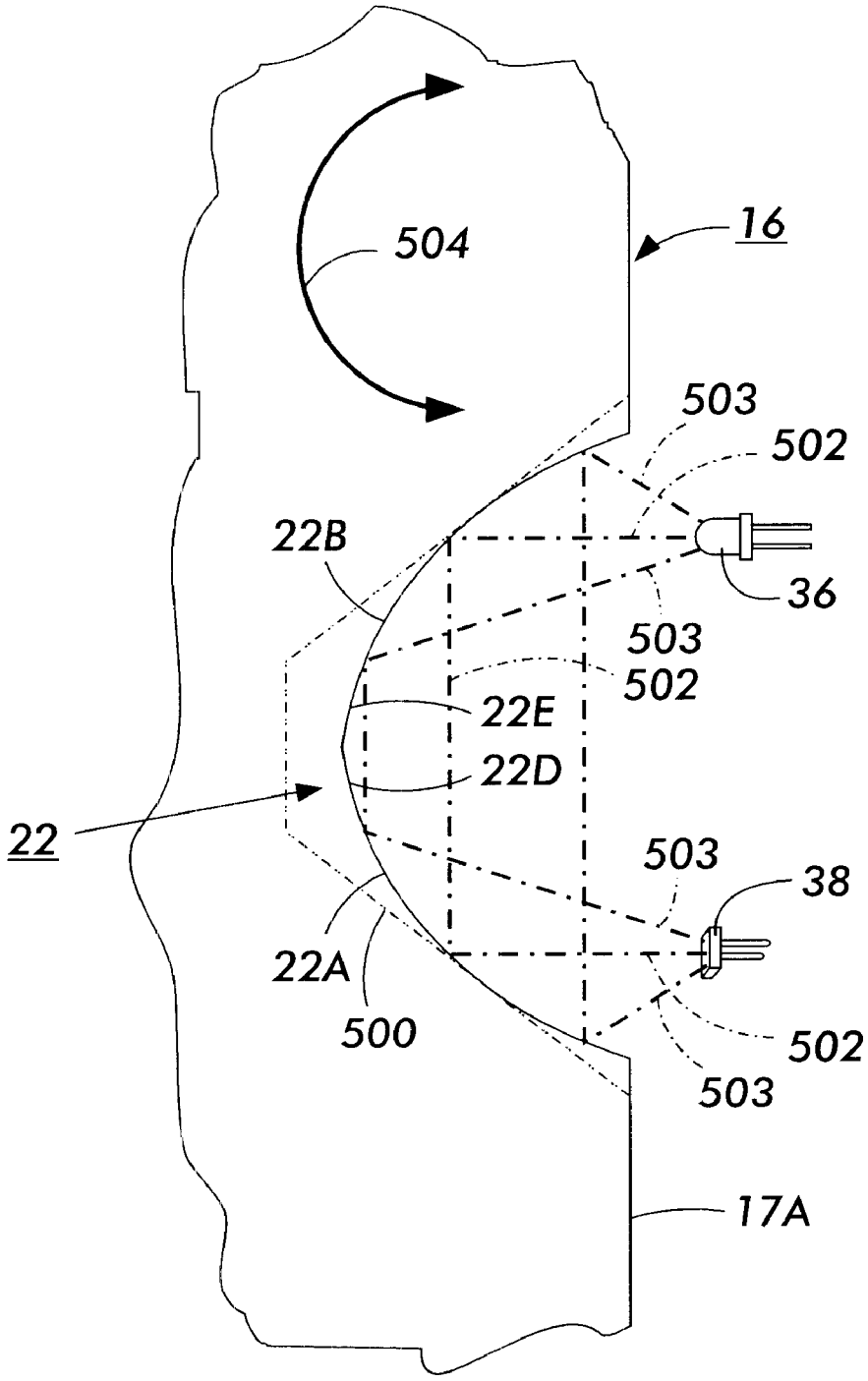
FIG. 5C is a cross-section of a duo-curvilinear reflective roof mirror element within the cartridge.

FIG. 5C is a cross section of light directing element 22 and a schematic reproduction of the assembly 30 showing the path of the light beam when the light directing element, here a duo-curvilinear arched roof mirror 22 is in position and thereby in combination, allows indication of the presence of an ink container 16. The essence of the present invention is directed to an improvement of allowed patent application Ser. No. 09/305,990 to Altfather et al. (hereinafter Altfather) and its parent, U.S. Pat. No. 5,997,121, incorporated herein by reference for its teaching. In the present invention, curved or arched surfaces are utilized to both reflect light, but more importantly focus and concentrate light which would otherwise be scattered. This improves system design and operation margins by virtue of light concentration and the generally improved sensitivity to light realized thereby. It also allows a tolerance for misalignment of the ink container 16 and housing 17 relative to the printer generally, and the optical sensing assembly 30 more particularly.

Here in the present invention, as schematically depicted in FIG. 5C, light from emitter 36 is directed towards arch roof member 22 and curvilinear surface 22B. This curvilinear surface focuses and reflects light towards curvilinear surface 22A which further focuses the light and reflects it towards receptor 38. Hence, this is a dual curvilinear type of preferred embodiment. For comparison, dashed line 500 outlines a typical arrangement as found in an Altfather embodiment. Center-line light rays 502 are still met with a 45 degree reflection angle at surfaces 22B and 22A (or if provided reflective foils 22E and 22D, respectively). However, all other rays 503 find differing angles as provided by surfaces 22B and 22A acting to gather and focus the light. This allows a tolerance for rotational misalignment of the container 16 in an orientational manner as indicated by line 504.

There are many arrangements of curvature which will allow operation of the present invention as will be apparent to one skilled in the art. In the duo-curvilinear arrangement depicted, one approach is an arc, the radius of which is two times the distance from the emitter 36 (or receptor 38) to the center-line reflection point. As will be understood by those skilled in the art, there are many other arrangements of both emitter location, receptor location, and curvilinear element shape and location which may be accommodated with the application of software such as a ray-tracing program (or other design means). For example, a single ellipse shape (a mono-curvilinear example) may be utilized, or in another alternative, two curves may be used as above but separated by a flat facet between. The essence of the invention is to accomplish both the focusing of the emitter source light while also redirecting that light, and is understood to encompass the above cited examples and other derivatives as would be apparent to those skilled in the art.

Figure 5D:
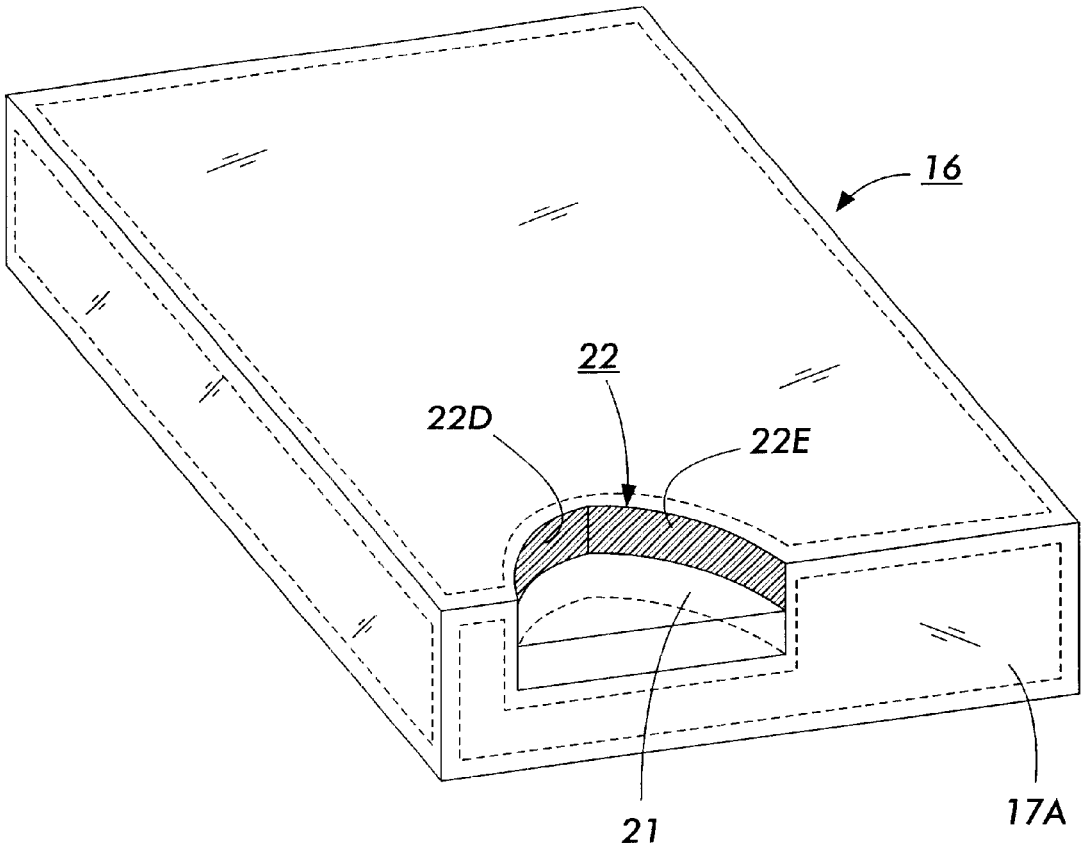
FIG. 5D is a three dimensional profile of one preferred embodiment arrangement of the invention where the two curvilinear elements are shown stacked one on top of the other rather than side by side.

FIG. 5D is a three dimensional profile of a preferred embodiment arrangement of the invention. Here the two duo-curvilinear elements, the arch roof mirror 22 (with reflective film 22D and 22E) for sensing the presence of the ink container 16, and arch member 21 for sensing the ink level, are shown stacked one on top of the other in wall 17A, rather than the side by side arrangement depicted in FIG. 2. This arrangement can facilitate the use of a single emitter for both the ink container presence sensing and the ink level sensing functions.

Figure 5E:
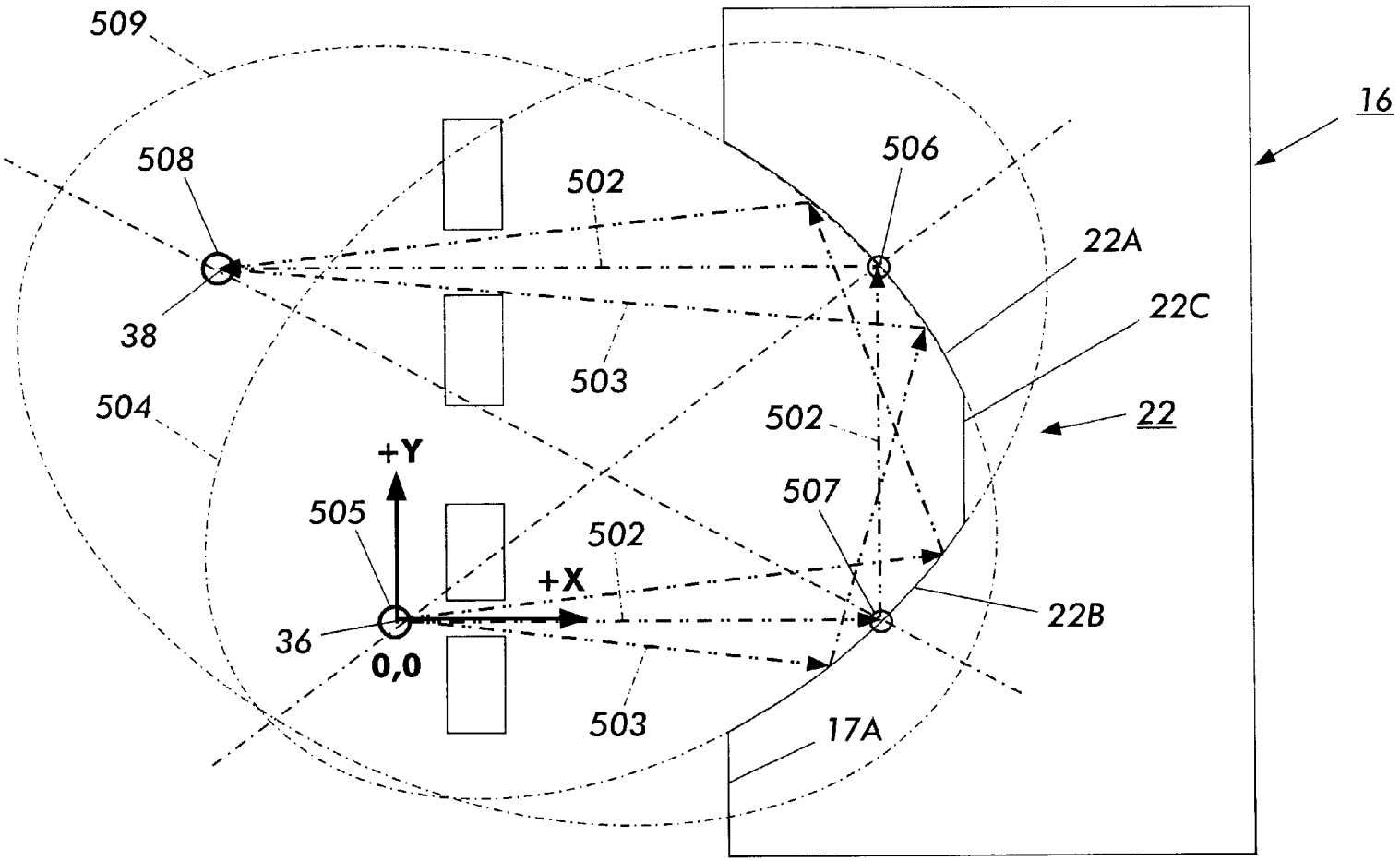
FIG. 5E is an alternative preferred embodiment utilizing ellipses to provide a duo-curvilinear profile.

FIG. 5E provides an alternative preferred embodiment utilizing dual ellipses to provide a duo-curvilinear profile. The purpose of the first ellipse 504 with given foci A1 505 and A2 506, is to provide an elliptical reflector 22B so arranged as to redirect the illumination from emitter 36 (coincident with focus A1 505), towards the second elliptical reflector 22A, The second elliptical reflector 22A having given foci B1 507 and B2 508. The destination of the reflected illumination is a point on elliptical reflector B coincident with focus A2 506.

Elliptical reflector 22B is best able to redirect the illumination towards the desired point, A2 506, when one of reflector A's foci is established at the point of origin for the illumination (emitter 36) and the other is established at a point on the surface of the second reflector 22A. This takes advantage of the ellipse's property that directs a ray emanating from a focus towards the other focus after specular reflection off the ellipse interior surface. That property is: the tangent at any point on an ellipse is at equal angle from the lines which connect the point and the two foci.

The purpose of the second ellipse 509 with foci B1 507 and B2 508, is to provide second elliptical reflector 22A so arranged as to redirect the illumination from the first elliptical reflector 22B, originating at a point coincident with focus B1 507, towards a detector 38, which is at a point coincident with focus B2 508.

Elliptical reflector 22A is best able to redirect the illumination towards the desired point when one of it's foci is established at the point of origin for the illumination, the surface of elliptical reflector 22B, and the other is established at a point on the detector 38. The great appeal in this preferred embodiment is the light concentrating properties from a such a duo-curvilinear arrangement will allow the elimination of any need for reflective foils. Once again, the ellipse property is taken advantage of to achieve this preferred embodiment profile.

The equation for an ellipse is . . .

$$\frac{x^2}{a^2} + \frac{y^2}{b^2} = 1$$

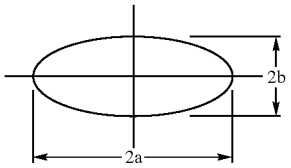

We can determine the values of the each ellipse's dimensions, $a_A$, $b_A$ and $a_B$, $b_B$ by using the following facts . . .

1) Ray $A_1B_1$ is parallel to ray $A_2B_2$←design intention
2) Ray $A_1B_1$ is perpendicular to ray $B_1A_2$←design intention
3) The distances $A_1B_1$, $B_1A_2$ and $A_2B_2$ are all free to be chosen by the system designer.
4) The distance $A_1A_2$ is twice the distance from the ellipse center to a focus.
5) The distance from the center to either focus is $\sqrt{a^2-b^2}$←property of ellipse
6) The sum of distances from any point on the ellipse to the foci is $2a$.←property of ellipse With some algebra we can see that . . .

$$A_1B_1 + B_1A_2 = 2a_A \rightarrow \boxed{a_A = 1/2(A_1B_1 + B_1A_2)} \quad 1)$$

from fact 6)

$$\sqrt{A_1B_1^2 + B_1A_2^2} = A_1A_2 = 2\sqrt{a_A^2 - b_A^2} \text{ from fact 5)} \quad 2)$$

$$\sqrt{A_1B_1^2 + B_1A_2^2} = 2\sqrt{a_A^2 - b_A^2}$$

$$A_1B_1^2 + B_1A_2^2 = 4[a_A^2 - b_A^2] \text{ squaring both sides}$$

$$A_1B_1^2 + B_1A_2^2 = 4[(1/4(A_1B_1 + B_1A_2)^2 - b_A^2]$$

substituting eqs. 1)

$$A_1B_1^2 + B_1A_2^2 = (A_1B_1^2 + 2A_1B_1B_1A_2 + B_1A_2^2) - 4b_A^2$$

$$\boxed{\sqrt{1/2(A_1B_1B_1A_2)} = b_A} \text{ solving for } b_A$$

In a similar manner, we can solve for the values $a_B$, and $b_B$.

It will be apparent to those skilled in the art that a single curvilinear profile may be realized in a manner similar to the above by proper placement of the foci for a single ellipse. This placement will be where the first and second foci are coincident with the emitter 36, and detector 38, respectively. The resultant ellipse where it intersects the ink tank 16 will then delineate a preferred profile for a curvilinear reflector 22. Of course, as will be apparent to one skilled in the art, the tank to emitter/detector distance will be small and place them in close proximity for a preferred embodiment.

To summarize the operation of the sensing system thus far, the presence of an ink container is confirmed. Further, it has been confirmed that the ink within the container is above preset levels, and therefore, a print job can be started. The ink level sensing system operation will now be described at a second time set to occur following some predetermined operational time.

OPERATION DURING PRINTING JOB

As printer 8 begins to print a print job corresponding to image input signals from P/C 52, ink is drawn from the foam in compartment 40 (FIG. 2) thereby reducing the saturation of the foam. A flow path is created that allows ink from compartment 42 to replenish the foam. Thus, the level of ink in compartment 42 gradually falls during usage of the printer. A low ink check can be initiated at the end of each print job or after some predetermined number of pixels, e.g., $7\times10^6$ pixels printed for any one color since the last check. For purposes of illustration, it will be assumed that a print job has been concluded drawing down the ink level in compartment 42 to a point below a predetermined trip point level represented by dotted line 80. A low ink level sensing procedure is initiated at this point.

Continued printing is interrupted and, as previously described, carriage 12 is moved to a position so that the housing wall 17A and light directing element 21 is opposite the sensing assembly 30. The controller again sequences through activation of light sources 34, 36 (the container detection may be omitted). FIG. 5B shows the effect of the low ink level on the light beam. Light from source 34 passes through wall 17A and is incident on curved surface area 21A at about 45°. Since the ink level has dropped below the 20% fill level, ink is no longer in contact with the back surface of curved surface area 21A which is now exposed to air with an index of refraction of 1.0. The angle of 42.9° is exceeded by the incident light on the facet; therefore, none of the incident light is transmitted through the surface. The rays are totally reflected back into the denser media resulting in total internal reflection (TIR) of the beam. All of the incident energy is reflected towards curved surface area 21B. Since the back of that facet is also exposed in air, all of the energy is now directed back towards photosensor 37. About 92% of the incident energy (minus any absorption) is returned to impinge on photosensor 37. The output signal from the photosensor is recognized by controller logic as being within a preset low ink level range. The controller performs a status check to see if the change from a previous station status is from "not empty" to "empty". Since this is the case for the instant example, the status log memory in controller 50 is set to "empty" status and a low ink level signal is generated and may be displayed at P/C display 55. The low ink signal can be used, depending on the system requirements, to merely display a low ink level to an operator, to halt print operation until a cartridge refill or replacement is performed or, in the preferred embodiment, to allow operation to continue but with a modified "low ink" status. As shown in FIGS. 3 and 4, the controller sends a signal to P/C 52 which displays an appropriate warning defining the ink container that has just been checked is low on ink. Each ink container contains a remaining quantity of ink which can be correlated into a number of pixels (or drops) remaining. This number may be different for each ink color. The low ink signal generated in the controller logic enables counter 60 to begin counting the number of pixels (drops) ejected from the printhead jets and the drawing down of ink within the ink tank. When the pre-established number of pixels have been counted, the ink tank is defined as out of ink, and printing is automatically disabled. The termination occurs before the tank is completely exhausted (level of about 2–5%) in order to insure that the printhead and its ink channel lines are not emptied, a condition which would jeopardize the reliability of the printhead. During the time between the first detection of low ink and declaration of out of ink, increasingly urgent messages may be displayed at the P/C display. It is understood that the pixel value of the remaining ink is dependent upon the frequency of the low ink checks.

Figure 6:
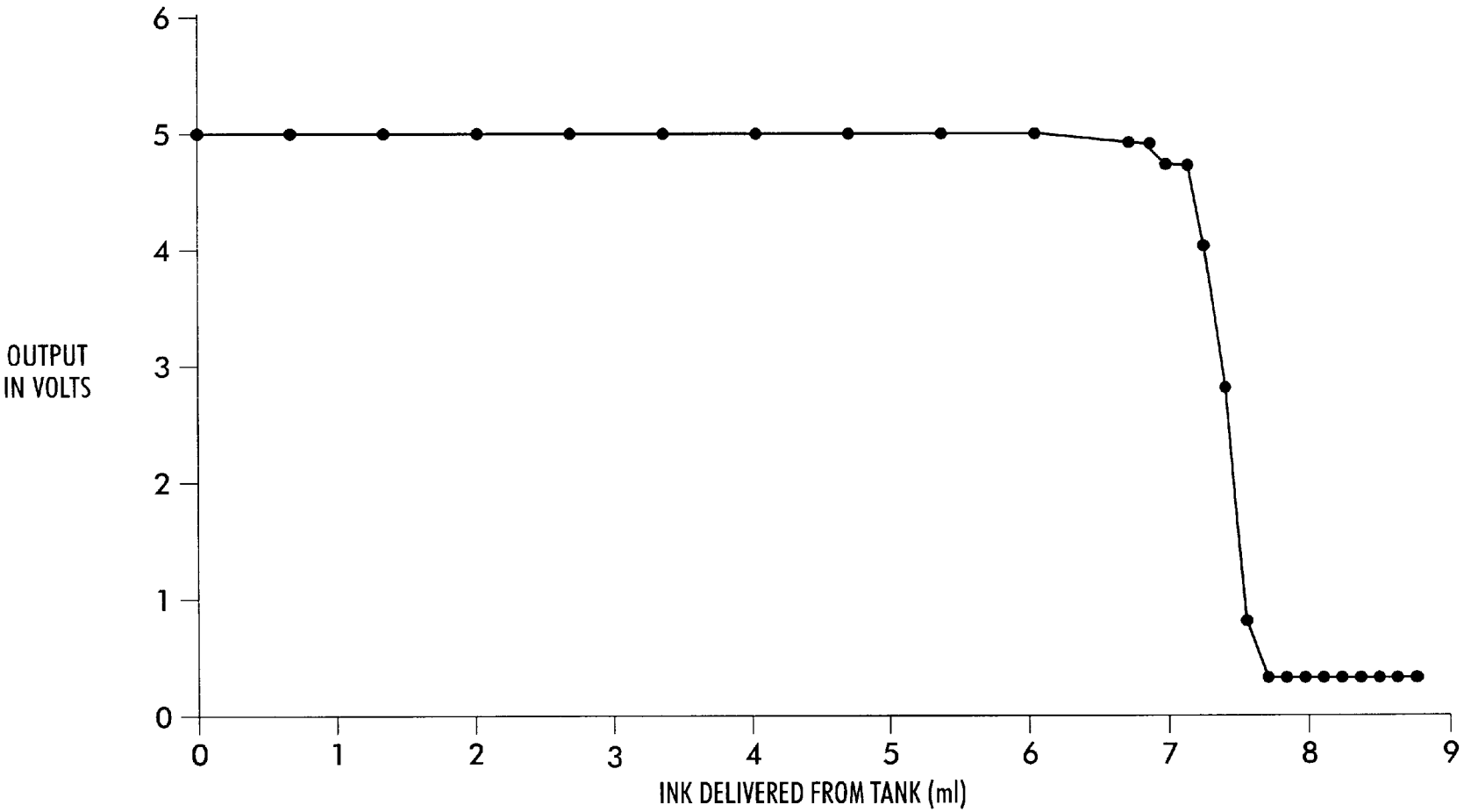
FIG. 6 is a plot of low ink sensing output signals versus volume of ink depleted from a cartridge.

The above scenario posited a condition wherein light directing element 21 was either completely immersed in ink or completely free of ink. In between these two cases is a transition represented by a monotonically increasing light level to the signal from LED 34 as the ink level gradually exposes more and more of curved surface area 21A to air. FIG. 6 shows a plot of ink, in milliliters (ml), delivered to the printhead against sensor output in volts. For the first 70% of ink delivered, the sensor current is low, and the voltage output across a comparison circuit in controller 50 is high. Between 70 and 75% depletion, a rapid transition occurs as the LED 34 output beam begins to be totally internally reflected from curved surface areas 21A and 21B of light directing element 21 thus increasing the output current from sensor 37 and causing a rapid voltage drop in the circuit.

Figure 7:
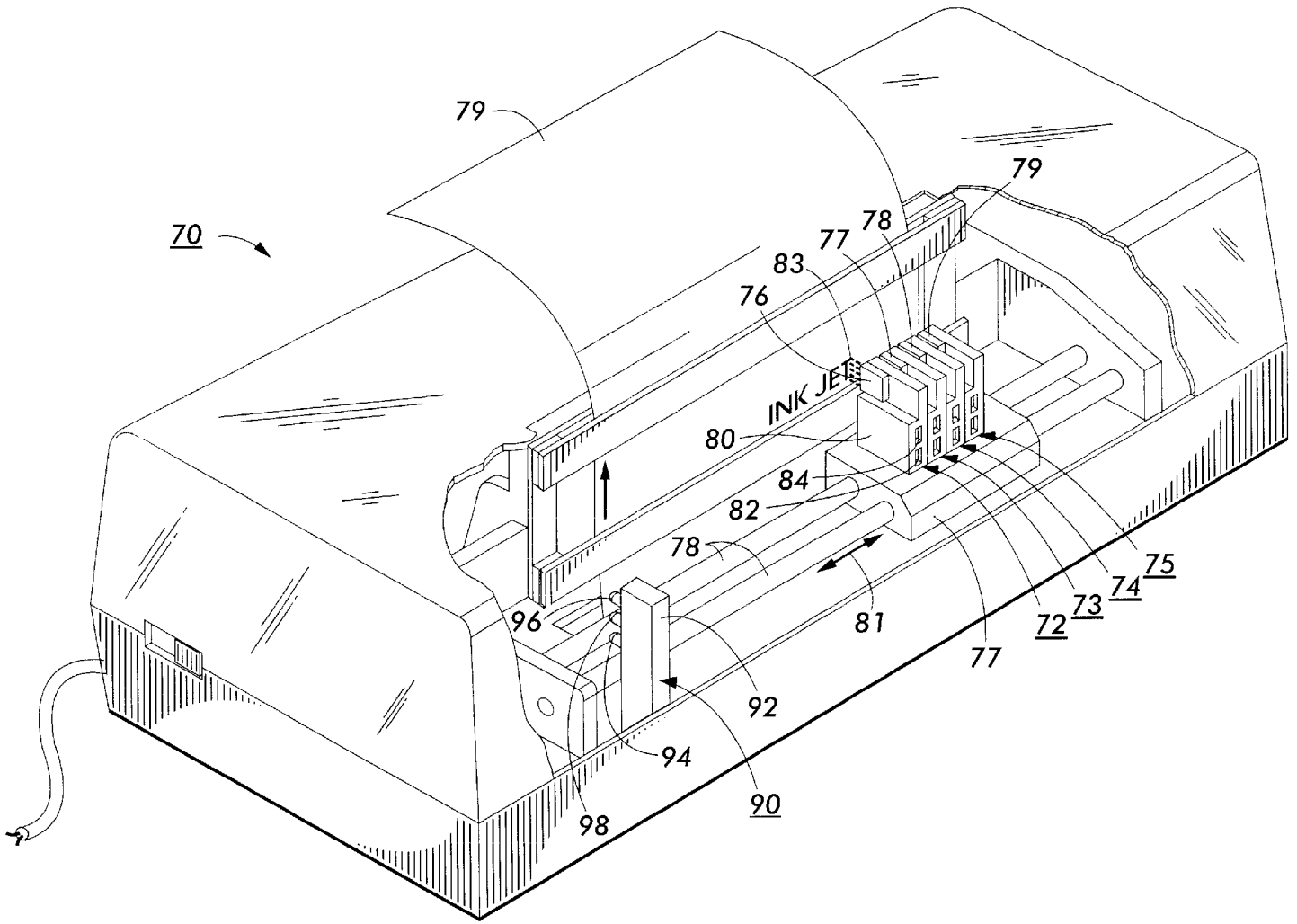
FIG. 7 illustrates a perspective view of a full color ink jet printer which incorporates the ink containers and low ink level sensing system of the present invention.

The invention may be used in other types of ink jet printing systems including full color printers. FIG. 7 shows a full color scanning type of printer. Referring to FIG. 7, a thermal ink jet printer 70 is shown. Several ink supply cartridges 72, 73, 74, 75, each with an integrally attached thermal printhead 76 to 79, are mounted on a translatable carriage 77. During the printing mode, the carriage 77 reciprocates back and forth on guide rails 78 in the direction of arrow 81. A recording medium 79, such as, for example, paper, is held stationary while the carriage is moving in one direction and, prior to the carriage moving in a reverse direction, the recording medium is stepped a distance equal to the height of the stripe of data printed on the recording medium by the thermal printheads. Each printhead has a linear array of nozzles which are aligned in a direction perpendicular to the reciprocating direction of the carriage. The thermal printheads propel the ink droplets 81 toward the recording medium whenever droplets are required, during the traverse of the carriage, to print information. The signal-carrying ribbon cables attached to terminals of the printheads have been omitted for clarity. The printer 70 can print in multiple colors, wherein each cartridge 72 to 75 contains a different color ink supply. For a representative color printer and additional control details, see for example, U.S. Pat. No. 4,833,491, the disclosure of which is incorporated herein by reference.

According to the invention, each of the ink containers forming part of cartridges 72–75 are of the same construction as the cartridge shown in FIG. 2, and for the purposes of the invention, each cartridge has an ink container having two prism reflectors formed in the wall facing outward. One reflector is associated with cartridge presence detection and the other with low ink detection. Cartridge 72 is shown having an ink container 80 with reflective members 82, 84. Cartridges 73–75 have similar containers and reflective members not specifically called out for ease of description. As in the single cartridge embodiment, a sensing assembly 90 includes a housing 92 within which are mounted a first light source 94 and a second light source 96 and a photosensor 98 located between the two light sources.

Figure 8:
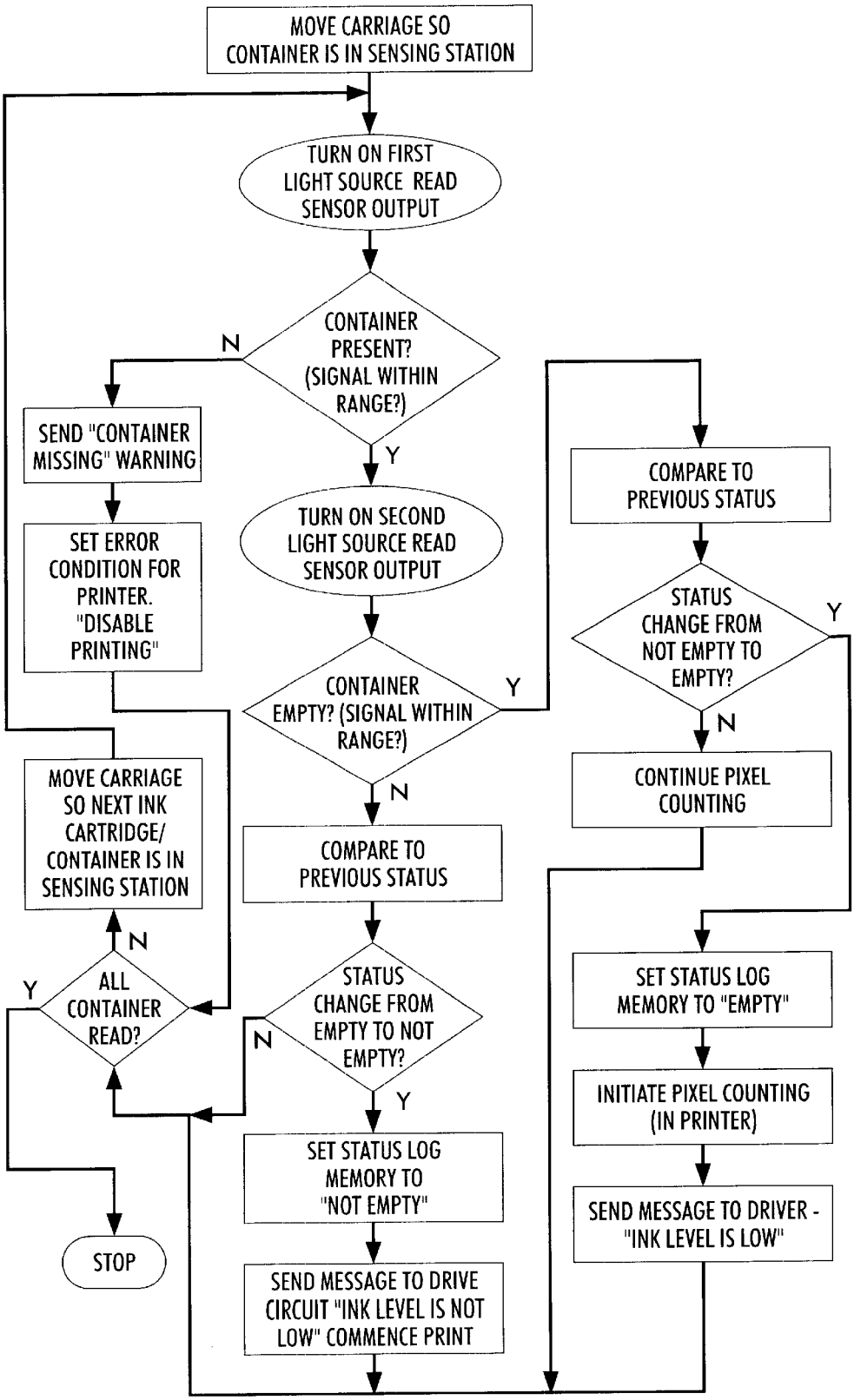
FIG. 8 is an algorithm for the FIG. 7 embodiment which is used to sequence the presence or absence of a container and the low ink sensing sequentially.

In operation and referring to FIGS. 4, 7 and 8, image signals from P/C 52 to controller 50 initiate a start print sequence. Carriage 77 is moved so as to position the cartridge 72 with first ink container 80 opposite the sensing assembly 90. Under control of controller 50, power source 56 is caused to sequentially energize light sources 94, 96 while measuring the output of photosensor 98. The sequencing and detection operation for cartridge 72 is the same as that previously described for cartridge 10. Source 96 is first energized to check that the cartridge is present (reflections from roof mirror 84 to the photosensor is within range), source 94 is turned on, and the ink level in the container system is determined after making comparisons with the previous status. (Reflections from light directing element 82 front surface are sensed by photosensor 98). Once cartridge 72 is serviced, carriage 77 is moved to position the next cartridge 73 in position to be sensed. The preceding process is enabled for each cartridge until all cartridges have been confirmed as being in place and all ink levels in the assembly ink containers are either within the acceptable levels or appropriate low ink level warnings have been displayed at the P/C.

While the embodiment disclosed herein is preferred, it will be appreciated from this teaching that various alternative modifications, variations or improvements therein may be made by those skilled in the art. A more efficient arrangement is possible for example (not shown) where a single light source is associated and utilized with both of the reflective elements 21, 22 in FIGS. 1 and 2.

In another example, while the FIG. 1 and FIG. 7 embodiments show the ink container mounted on a scanning carriage which is periodically moved to a detection station, the ink containers may be positioned in a fixed location and connected to the scanning printhead via a flexible ink supply line. For the FIG. 1 embodiment, container 16 would be fixed in position opposite optical assembly 30 and connected to printhead 18 via a flexible tube. For the FIG. 7 embodiment, four optical assemblies would be located outside the print zone opposite from an associated ink container, each of the ink containers connected to the respective printhead cartridge via flexible ink couplings. For the case of a full width array printhead of the type disclosed, for example, in U.S. Pat. No. 5,221,397, a remote ink container is connected to an ink manifold which connects ink with the plurality of input modules which are butted together to form the full width array. One or more optical assemblies would be located opposite the modified ink container.

What is claimed is:

1. An ink container comprising:

a housing; and a duo-curvilinear light directing element on a wall of the housing for directing light received at the duo-curvilinear light directing element away from the wall of the housing, the duo-curvilinear light directing element comprising a first and second reflector, the first reflector having a shape derived from a first ellipse, and the second reflector having a shape derived from a second ellipse.

2. The ink container of claim 1, wherein at least a portion of the wall is light transmissive.

3. An ink container for use in a liquid ink printer, comprising:

a housing defining a chamber for storing a supply of liquid ink; and an arched roof mirror comprising a first and a second curvilinear reflector on the exterior of a wall of the housing, wherein the first curvilinear reflector substantially completely reflects light received at the first curvilinear reflector toward the second curvilinear reflector, and the second curvilinear reflector substantially completely reflects light received at the second curvilinear reflector away from the wall of the housing on a light path offset from and parallel to the light path of the light received at the first reflector.

4. The ink container of claim 3, additionally comprising a liquid ink outlet through a first wall of the housing for fluid connection with an ink jet printhead.

5. The ink container of claim 4, additionally comprising a printhead having ink ejecting orifices and a fluid conduit for connection to the liquid ink outlet of the ink container housing.

6. The ink container of claim 5, wherein the printhead is detachably connected to the container housing.

7. The ink container of claim 3, wherein the container is attachable to a printhead comprising ink ejecting orifices.

8. The ink container of claim 3, wherein the first curvilinear reflector has a shape derived from a first ellipse, and the second curvilinear reflector has a shape derived from a second ellipse.

9. A sensing system for detecting a presence of an ink container and a level of ink therein comprising:

a first curvilinear light directing element forming part of the ink container;

a light source having output beams directed toward the first curvilinear light directing element when in an ink container detect mode;

a first photosensor for detecting a presence or absence of light directed from the first curvilinear light directing element and for generating an output signal indicative thereof;

a second curvilinear light directing element forming part of the ink container, the light source having output beams directed toward the second curvilinear light directing element when in a low ink level detect mode; and a second photosensor for detecting light directed from the second curvilinear light directing element, the level of detected light and, hence, the level of the photosensor output being representative of a presence or absence of the ink level adjacent the interior surface of the second curvilinear light directing element.

10. The ink container of claim 9, wherein the first curvilinear light directing element has a shape derived from a first ellipse, and the second curvilinear light directing element has a shape derived from a second ellipse.

11. The ink container of claim 9, wherein reflective foil is applied to the first and second curvilinear light directing elements.

* * * * *